US005155912A

United States Patent [19]

Toth

[11] Patent Number: 5,155,912

[45] Date of Patent: Oct. 20, 1992

[54] BOWLING BALL TOOL & KIT

[75] Inventor: Peter Toth, Simi Valley, Calif.

[73] Assignee: Randy La Fata, Moorpark, Calif.

[21] Appl. No.: 700,971

[22] Filed: May 16, 1991

[51] Int. Cl.[5] ..... A26B 3/06

[52] U.S. Cl. ..... 30/169; 15/236.1; 51/205 WG; 273/63 B

[58] Field of Search ..... 30/169, 301, 316; 15/236.1; 273/63 B, 63 R; 51/391-393, 205 R, 205 WG

[56] References Cited

U.S. PATENT DOCUMENTS 3,168,799 2/1965 Johnson ..... 51/205 R X
5,023,988 6/1991 Lamond ..... 30/169 X

*Primary Examiner*—Douglas D. Watts
*Attorney, Agent, or Firm*—John J. Posta, Jr.

[57] ABSTRACT

The improved bowling ball tool kit includes a tool having an elongated shaft with an expanded handle on one end and one of a number of bowling ball finger hole scrapers of differing diameters supplied by the kit. The scrapers are separately releasably attachable to the opposite end of the shaft of the tool. The scrapers are preferably formed of silicon carbide or another hard material which will readily ream, slice or abrade the plastic of a bowling ball to enlarge its finger holes. The kit also includes a connector, preferably in the form of a threaded connector bolt to releasably hold the scrapers in place by threading into the shaft end after passing through a central hole in the scraper. Each of the scrapers is frusto-conical disc and is mountable on the shaft end so that the sides of the disc taper down and away from the shaft. The tool and kit are simple, durable, small, portable, inexpensive and efficient to enlarge bowling ball finger holes so as to accommodate fingers with gradually increase in diameter as bowling is practiced.

9 Claims, 1 Drawing Sheet

BOWLING BALL TOOL & KIT

BACKGROUND OF THE INVENTION

1. Field of the Invention

The present invention generally relates to tools and more particularly to an improved bowling ball tool and kit containing the same.

2. Prior Art

When a plastic bowling ball is purchased, two or three finger holes are drilled into the ball by a professional ball drilling machine at the sales store for the ball, in order to accommodate the bowlers' hand. The holes are dimensioned so that the fingers can slip easily into and out of the ball for proper gripping and release, but the holes are not loose. However, as the bowler continues to bowl, his or her fingers gradually expand in diameter through the exercise so that the initially properly fitting bowling ball eventually becomes too tight in the finger holes, causing finger burn and inhibiting a proper release of the ball during bowling.

The ball must then be brought back to the bowling ball sales outlet or to another professional facility for the finger holes to be redrilled to the proper larger size. This is an expense and inconvenience. Moreover, the bowler usually delays this procedure due to such expense and inconvenience until the finger hole problem becomes severe and seriously interferes with the bowlers' bowling technique.

Accordingly, it would be desirable to be able to provide a simple, inexpensive and efficient means for the bowler himself or herself to be able to rapidly and accurately expand the bowling ball finger holes as and when such expansion is needed, in order to provide maximum ball efficiency and comfort, and avoid damaging the bowlers' fingers and technique.

SUMMARY OF THE INVENTION

The improved bowling tool and kit satisfy all the foregoing needs. The tool and kit are substantially as set forth in the Abstract of the Disclosure.

Thus, the tool comprises an elongated shaft of metal, plastic, ceramic, cermet, or the like, with an expanded handle on one end and a scraper on the other end. Preferably, the scraper is detachable and includes a releasable connector. The kit includes the shaft with handle, a plurality of the scrapers of differing diameters and a connector to releasably hold any given scraper against the shaft for use.

Each scraper is in the form of a hardened disc, preferably of silicon carbide or the like, capable of readily and rapidly scraping or showing or peeling the plastic defining a bowling ball finger hole to enlarge the hole. The disc is of a desired thickness and is frusto-conical; that is, it has a rear surface of greater diameter than its front surface, with the sidewall thereof therebetween uniformly sloping down from rear to front. The outer edges of the rear and front disc surfaces are sharp and act as scraper-cutters. The scraper can be easily angled by the shaft in the finger hole to selectively peel, scrape or cut thin strips of plastic from the ball portion defining the hole, thus gradually enlarging the hole.

Preferably, each disc has a central hole perpendicular to the main plane of the disc and through which the threaded shank of an expanded head-type connector bolt passes, the shank being threaded into a corresponding longitudinal hole in the end of the shaft opposite the handle, in order to releasably hold the disc in place.

The tool and kit are simple, inexpensive, durable, easy and efficient to use and capable of enlarging a finger hole to a controlled degree in a short period of time and other aspects of the invention are set forth in the following detailed description and accompanying drawings.

DRAWINGS

DETAILED DESCRIPTION

FIGS. 1-3

Figure 1:
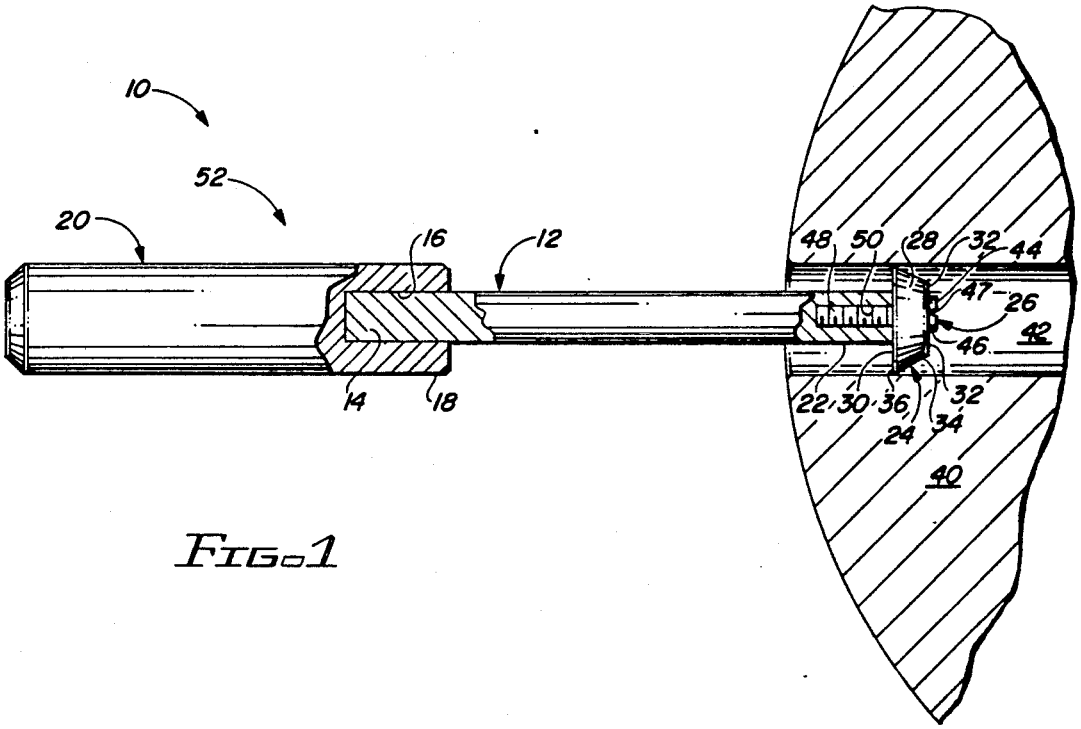
FIG. 1 is a schematic side elevation, partly broken away, of a preferred embodiment of the improved bowling ball tool of the present invention, shown inserted into a bowling ball finger hole.
Figure 2:
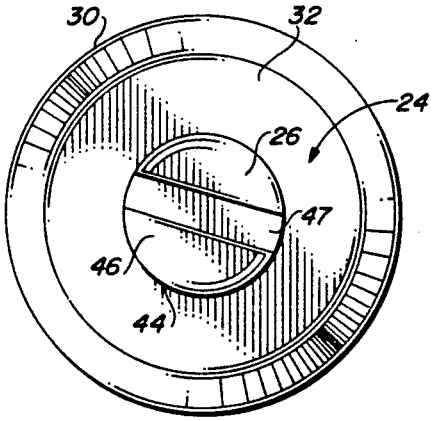
FIG. 2 is an enlarged front elevation of the scraper and connector bolt of FIG. 1; and, FIG. 3 is an enlarged front elevation of a second scraper of smaller diameter than the scraper of FIG. 2, together with the connector bolt of FIG. 1, the tool of FIGS. 1 and 2 forming with the second scraper of FIG. 3 a preferred embodiment of the improved bowling ball tool kit of the present invention.

Now referring more particularly to the drawings, a preferred embodiment of the improved bowling ball tool of the present invention is schematically depicted in FIGS. 1 and 2. Thus, tool 10 is shown, which comprises an elongated preferably cylindrical shaft 12 of hard durable metal, ceramic, cermet, plastic or the like, one end 14 of which is force fitted, glued or otherwise preferably permanently secured in an opening 16 in one end 18 of an elongated, preferably cylindrical, expanded diameter handle 20. Handle 20 can be of the same or a different material, such as wood, from that of shaft 12. If desired, handle 20 can be integral with shaft 12.

To the opposite end 22 of shaft 12 is releasably connected a scraper 24 by means of a connector 26. Scraper 24 is in the form of a frusto-conical disc 28 having a rear circular surface 30 of greater diameter than but concentric with a front circular surface 32, with a uniformly downwardly and forwardly sloping rim or sidewall 34. The outer periphery 36 of surface 30 is sharp, as is the outer periphery or edge 38 of surface 32. These two edges 36 and 38 form the cutting, peeling and scraping means for scraper 32.

Disc 28 is of very hard material, such as high carbon steel, but preferably a hard carbide such as silicon carbide, or a metal or carbide material which has been surface impregnated with diamond dust or chips. Edges 36 and 38 hold their cutting ability and are easily capable of readily and rapidly shaving and peeling wafer thin strips or plastic from the area of the bowling ball defining finger hole 42, in order to expand hole 42 to a desired finger size.

Disc 28 is releasably held in place against end 22 of shaft 12 by connector 26 which preferably comprises a bolt 44 of hard metal or the like, having expanded head 46 bearing a transverse slot 47 therein, and having a threaded shank 48. Shank 48 passes through a central hole (not shown) disposed through disc 28 in a direction perpendicular to the main plane of disc 28; and engages a threaded opening 50 in shaft 12, which opening 50 is disposed along the longitudinal axis of shaft 12. Thus, disc 28 can be easily tightened against shaft end 22 by bolt 44 and can be just as easily removed therefrom. If desired, disc 28 could be permanently secured to shaft 12. Tool 10 may be of any suitable size; for example, it may have an overall length of about 5–7 inches.

Figure 3:
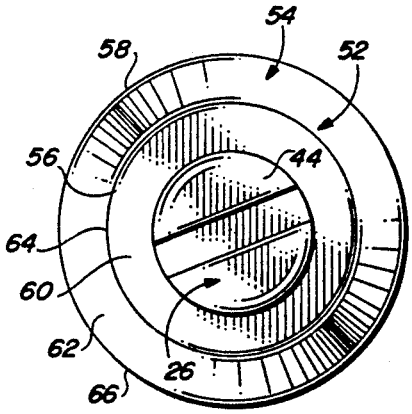

A preferred embodiment of the improved bowling ball tool kit of the present invention is shown in FIGS. 1–3. Thus, kit 52 is shown which comprises tool 10 of FIGS. 1 and 2, plus the second scraper 54 of FIG. 3. Scraper 54 can be substituted for scraper 24 and differs therefrom only in being of smaller diameter. Thus, scraper 54 is a frusto-conical disc 56 with a rear circular surface 58 of greater diameter than front circular surface 60, which is separated therefrom by a rim or annular, downwardly and forwardly sloping sidewall 60. This arrangement provides peripheral rear and front cutting edges 64 and 66. FIG. 3 shows bolt 44 disposed against disc 56.

Disc 56 will be used in place of disc 28 on shaft 12 in kit 52 when finger hole 42 is too small to accommodate disc 28. It will be understood that kit 52 can include a further number of scraper discs substantially identical to discs 28 and 56, but differing therefrom only in diameter.

Tool 10 and kit 52 are sufficiently small, light in weight and inexpensive so that they can be purchased by a bowler and carried along by the bowler for finger hole adjusting during bowling practice, a big advantage over non-portable bowling shop machines. Thus, the bowler can first have a few games and let his or her fingers swell before making the necessary finger hole adjustment on the spot using tool 10 and kit 52.

Scraping out finger hole 42 with tool 10 can be easily accomplished by the bowler merely by inserting tool 10 in hole 42 and then tilting disc 28 by handle 20 to engage it with the plastic lining of hole 42. A thin strip is then sliced or abraded from the lining of the ball by working tool 10 back and forth in hole 42. This procedure can then be stopped, tool 10 can be withdrawn, hole 42 can be emptied and then the bowlers' finger can be tried therein to make sure the hole size is right. Further scraping and finger testing can proceed as needed until a perfect fit is obtained. Rough spots in hole 42 can be taken down by tool 10 in order to fully custom fit hole 42 to the bowlers' finger.

Accordingly, tool 10 and kit 52 are of improved utility. Various modifications, changes, alterations and additions can be made in the improved tool and kit of the present invention, their components and parameters. All such modifications, changes, alterations and additions as are within the scope of the appended claims form part of the present invention.

What is claimed is:

1. An improved tool for enlarging the finger hole in a plastic bowling ball, said tool comprising, in combination:

a) an elongated shaft having a handle on one end; and, b) a bowling ball finger hole scraper connected to the end of said shaft opposite said handle end, said scraper including a sharp elongated member extending transversely of said shaft and having a cutting edge of a material harder than plastic so as to readily shave and scrape plastic from the finger hole of a bowling ball, said scraper being frusto-conical, tapering from the rear end thereof to the front end of said scraper.

2. An improved tool for enlarging the finger hole in a plastic bowling ball, said tool comprising, in combination:

a) an elongated shaft having a handle on one end;

b) a bowling ball finger hole scraper connected to the end of said shaft opposite said handle end, said scraper having a cutting edge of a material harder than plastic so as to readily shave and scrape plastic from the finger hole of a bowling ball, said scraper being frusto-conical, tapering from the rear end thereof to the front end of said scraper, and c) wherein said scraper comprises a frusto-conical disc of carbide, said disc having a circular rear surface and a circular front surface of lesser diameter than said rear surface spaced therefrom by a forwardly and downwardly sloping sidewall, the outer edge of said front and rear surfaces comprising plastic-cutting means.

3. The improved bowling ball tool of claim 2 wherein said disc comprises silicon carbide.

4. The improved bowling ball tool of claim 1 wherein said scraper is releasably secured to said opposite end of said shaft by a connector.

5. The improved bowling ball tool of claim 4 wherein said scraper comprises a disc with central hole and wherein said connector comprises a bolt having an expanded head and a threaded shank, the latter extending through said disc hole and releasably engaging a threaded hole in said shaft to releasably hold said disc against said shaft.

6. An improved bowling ball tool kit, said kit comprising, in combination:

a) an elongated shaft having a handle on one end;

b) a plurality of frusto-conical bowling ball finger hold scrapers which include a sharp elongated member extending transversely of said shaft and since this angle is having cutting edges and made of material harder than plastic so as to readily ream plastic from the finger hole of a bowling ball; and, c) a connector for releasably connecting each of said scrapers, in turn, to the end of said shaft opposite said handle.

7. The improved bowling ball tool kit of claim 6 wherein said scrapers are discs of carbide.

8. The improved bowling ball tool kit of claim 7 wherein each of said discs is made of silicon carbide and is adapted to be releasably secured to said shaft by said connector and wherein, the outer edges of both ends of said disc comprising plastic-cutting means.

9. The improved bowling ball tool kit of claim 8 wherein said connector comprises a bolt with expanded head and threaded shank which passes through a central hole in said disc and into threaded releasable engagement with said shaft.

* * * * *